United States Patent [19]

McClure et al.

[11] 4,155,062

[45] May 15, 1979

[54] THERMALLY SENSITIVE ELECTRICAL SWITCH

[75] Inventors: Gerald L. McClure, Warren; Dean C. Duhame, Roseville, both of Mich.

[73] Assignee: Essex Group, Inc., Fort Wayne, Ind.

[21] Appl. No.: 835,655

[22] Filed: Sep. 22, 1977

[51] Int. Cl.[2] ..... H01H 37/36

[52] U.S. Cl. ..... 337/329; 337/399; 200/264; 338/100

[58] Field of Search ..... 337/114, 122, 139, 329, 337/331, 382, 393, 399; 338/100, 114; 200/159 B, 264

[56] References Cited

U.S. PATENT DOCUMENTS

| | | | |
|---|---|---|---|
| 3,386,067 | 5/1968 | Costanzo | 338/100 |
| 3,800,112 | 3/1974 | DuRocher | 200/264 X |
| 3,839,694 | 10/1974 | DuRocher et al. | 337/382 |
| 3,952,173 | 4/1976 | Tsuji et al. | 200/264 |
| 3,974,470 | 8/1976 | DuRocher | 338/100 |

*Primary Examiner*—George Harris
*Attorney, Agent, or Firm*—Learman & McCulloch

[57] ABSTRACT

A thermally sensitive switch has a thermally conductive body within which is a chamber into which extends at least one electrically conductive terminal. Occupying the chamber is an elastomeric body which is expansible and contractile in response to increases and decreases, respectively, in its temperature. The elastomeric body may be normally conductive or normally nonconductive, but in either event is conductive when in its expanded condition. When in its expanded, conductive condition, the body engages the terminal and is operable to establish a current path through the body to the terminal. The body may function as an on-off switch or as a rheostat, depending upon the composition of the body.

16 Claims, 34 Drawing Figures

THERMALLY SENSITIVE ELECTRICAL SWITCH

This invention relates to thermally sensitive electrical switches and more particularly to thermally sensitive switches which lend themselves to a high degree of miniaturization without impairment of their ability to be used in connection with solid state devices such as thyristors, transistors, diodes, and the like. Switches constructed in accordance with the invention also are useful in monitoring temperatures of coolants, lubricants, and other fluids utilized in motor vehicles, machine tools, and other instances in which an increase in the temperature of a fluid is indicative of a problem. Switches constructed according to one embodiment of the invention may be normally conductive or normally nonconductive, whereas switches constructed according to another embodiment of the invention may be normally nonconductive. According to a further embodiment of the invention, the switch may be rheostatic in operation in the sense that its resistance decreases as its temperature increases.

The prior art contains many examples of thermally sensitive electrical switching devices. Some of the known switches utilize a crystalline wax substance which occupies a thermally sensitive casing and which, upon having its temperature raised to a critical value, expands and generates sufficient force or power to effect the opening or closing of switch contacts via force transmitting means. Others of the known switches utilize thermally sensitive bimetallic elements which change their configuration in response to changes in temperature so as to effect opening or closing of switch contacts. Each of these kinds of switches presents problems in calibration. Further, the crystalline wax and bimetallic elements are relatively expensive and require substantial skill in their assembly with other components, thereby resulting in a switch which is relatively costly compared with one constructed in accordance with the invention. Furthermore, the known kinds of thermally sensitive switches do not lend themselves readily to miniaturization.

A switch constructed in accordance with the invention utilizes a housing of thermally sensitive material within which is a chamber occupied by a thermally expansible and contractile elastomeric body containing electrically conductive particles. A conductive electrode or terminal is supported by the housing in confronting relation to the elastomeric body. If the body is normally nonconductive, the terminal and the body normally may engage one another. If the body is normally conductive, the body and the terminal normally may be in engagement or spaced from one another. In any case, an increase in the temperature of the elastomeric body will cause the latter to expand, but the body is restrained from expanding in any direction other than toward the electrode. In its expanded condition, the body in all cases is conductive and engages the electrode, thereby providing for circuit continuity between the body and the electrode. The elastomeric body can be so constructed that its resistance, when conductive, is substantially uniform or, alternatively, the elastomeric body can be so constructed that its resistance decreases as its temperature increases. The switches may have a single terminal, in which case the housing may be electrically conductive, or the switches may have a pair of terminals, in which case the housing may be electrically conductive or nonconductive. In all cases, the switches may be miniaturized so as to have extremely small overall dimensions.

Several embodiments of switches constructed in accordance with the invention are described in the following specification and illustrated in the accompanying drawings, wherein.

Figure 1:
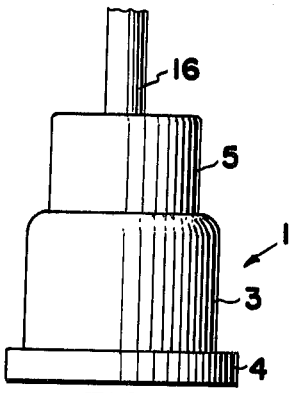
FIG. 1 is an elevational view of a rheostatic switch constructed in accordance with one embodiment of the invention.

The switch embodiment shown in FIGS. 1-5 comprises a housing 1 formed of thermally sensitive material, such as aluminum or an alloy thereof. The housing 1 has a base or bottom wall 2 from which extends an upstanding annular wall 3. A flange 4 extends beyond the periphery of the wall 3 and may be exteriorly threaded, if desired, for accommodation in a correspondingly threaded opening of a member (not shown) containing a fluid the temperature of which is to be monitored.

Accommodated within the wall 3 is a block 5 formed of insulating material which is relatively thermally insensitive. The block 5 has a peripheral flange 6 which is accommodated in an annular groove 7 formed in the wall 3, the upper edge of the wall being rolled over the flange 6 so as securely to affix the block 5 in the housing 1.

Seated on that surface of the block 5 which confronts the base 2 is an insulator 10 having a diametral dimension corresponding to the corresponding inner dimensions of the wall 3. The insulator 10 has a central opening 11 therein for a purpose presently to be explained.

The flange 6 and the groove 7 cooperate to locate the confronting surfaces of the base 2 and the body 5 a predetermined distance from one another, and the thickness of the insulator 10 is so selected that the distance between the latter and the wall 2 forms within the housing a chamber 8 of predetermined volume.

Occupying the chamber 8 is a disc-like switching member 9 having a diameter corresponding to that of the chamber 8 and a thickness corresponding to the height of the chamber between the wall 2 and the insulator 10.

The body 5 is provided with a central bore 12 through which extends a conductor 13 terminating at one end in an enlarged head or terminal 14 which occupies a counterbore 15 formed in the inner face of the body 5. The terminal 14 is aligned with the opening 11 in the insulator 10.

The conductor 13 is encircled by an insulating jacket 16. The conductor 13 may be connected to an electrical instrumentality 17, such as a lamp or gauge which, in turn, is connected to the positive terminal 18 of a source of electrical energy, such as a battery.

The switching member 9 is composed in part of a deformable, thermally expansible and contractile material, such as silicone rubber, having a high coefficient of thermal expansion. Preferably, the silicone rubber is one of many having a linear rate of expansion and contraction. The switching member also includes a substantial quantity of electrically conductive particles formed of materials such as iron, carbon, and the like which possess the property of offering lesser electrical resistance the greater the compressive force to which they are subjected. The quantity of conductive particles contained within the switching member 9 preferably is such that the member 9 is conductive without the application of compressive force, but as the member 9 is compressed, the electrical resistance through the member 9 decreases. The switching member 9, therefore, is rheostatic in the sense that its resistance decreases as the compression of the member increases.

In the disclosed embodiment, the wall 3 of the housing 1 constitutes a second terminal. The housing 1 may be grounded in any suitable manner.

Figure 2:
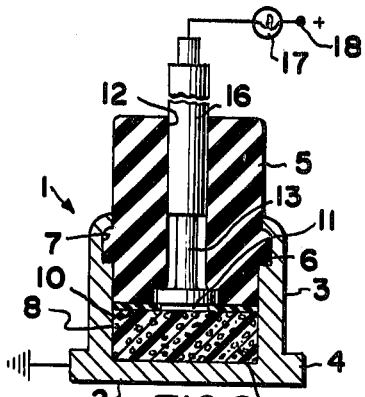
FIG. 2 is a vertical sectional view of the switch shown in FIG. 1.

When the parts of the apparatus are in the condition indicated in FIG. 2, the member 9 is in its normal, non-expanded condition and is in snug engagement with the walls 2 and 3 of the chamber 8 and with the confronting surface of the insulator 10. The opening 11 in the insulator 10 is unoccupied, however, thereby providing a space between the member 9 and the terminal 14. In these conditions of the parts, therefore, there is an open circuit between the member 9 and the terminal 14.

Figure 4:
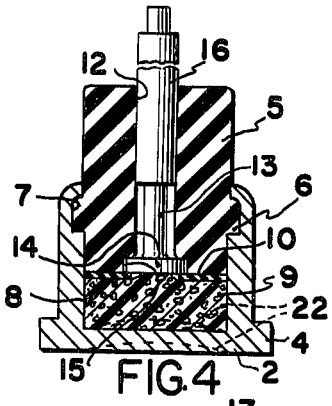
FIG. 4 is a view similar to FIG. 2, but illustrating the switch in conductive condition.
Figure 3:
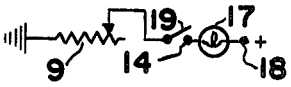
FIG. 3 is a schematic circuit diagram of the switch shown in FIG. 2 and illustrating the latter in open circuit condition.
Figure 5:
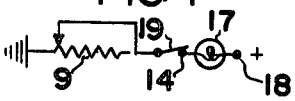
FIG. 5 is a circuit diagram illustrating the switch of FIG. 4 in conductive condition.

When the temperature of the housing 1 increases, the increase in temperature will be transmitted by conduction through the walls 2 and 3 to the switching member 9, thereby causing the latter to expand. The member 9 may not expand radially, or axially in any direction other than toward the terminal 14 through the opening 11. Since the member 9 normally is conductive, expansion of the member 9 through the opening 11 into engagement with the terminal 14 establishes conductivity between the members 9 and 14, as is shown in FIG. 4. Expansion of the member 9 into engagement with the terminal 14 thus constitutes an initial switching function which is represented by the switch 19 in FIGS. 3 and 5.

Following engagement between the members 9 and 14, a further temperature rise exerts an expansive force on the member 9, but further expansion is prevented by the confines of the chamber 8 and the terminal 14. The member 9 thus becomes compressed, thereby subjecting the conductive particles to greater compressive force, as a consequence of which the resistance of the member 9 decreases, as is indicated by a comparison of FIGS. 3 and 5.

When the housing 1 cools, the member 9 also cools, thereby enabling it to contract until it finally returns to the condition shown in FIG. 2.

Figure 6:
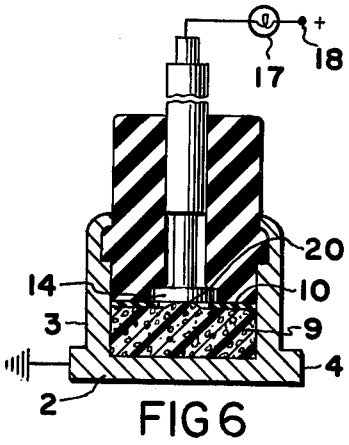
FIG. 6 is a sectional view similar to FIG. 2, but illustrating a modified form of rheostatic switch.
Figure 8:
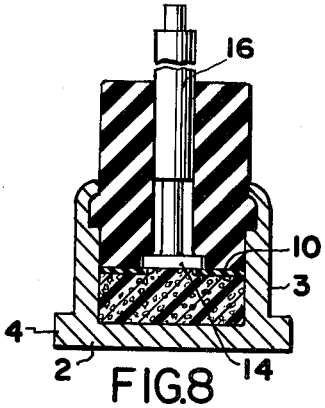
FIG. 8 is a view similar to FIG. 6 and illustrating the latter in adjusted condition.
Figure 10:
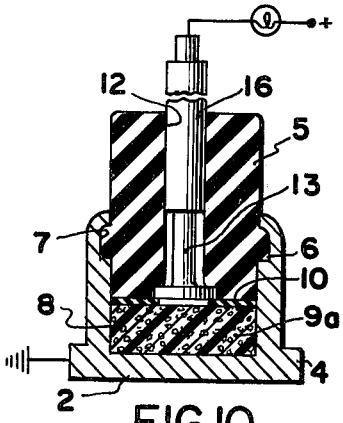
FIG. 10 is a view similar to FIG. 6, but illustrating a further modification of the invention.
Figure 7:
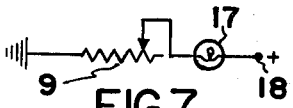
FIG. 7 is a schematic diagram illustrating the circuit of the switch shown in FIG. 6.
Figure 9:
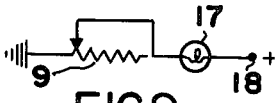
FIG. 9 is a schematic diagram of the switch circuit shown in FIG. 8.
Figure 11:
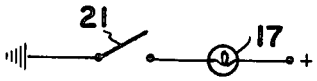
FIG. 11 is a schematic diagram of the switch circuit illustrated in FIG. 10.
Figure 12:
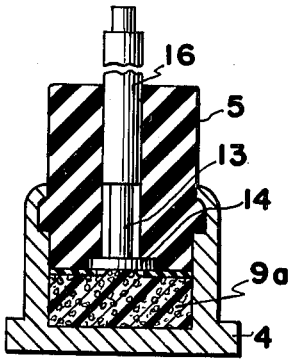
FIG. 12 is a view similar to FIG. 10, but illustrating the switch of FIG. 10 in adjusted condition.
Figure 14:
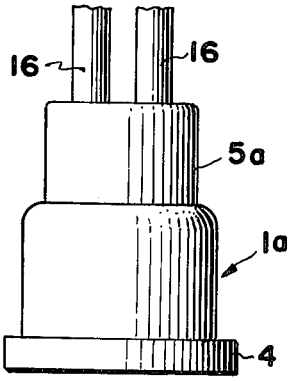
FIG. 14 is a view similar to FIG. 1, but illustrating a modified form of the invention.
Figure 15:
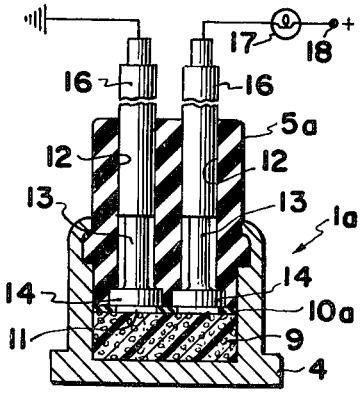
FIG. 15 is a vertical sectional view of the switch shown in FIG. 14 and illustrating the latter in open or non-conductive condition.
Figure 13:
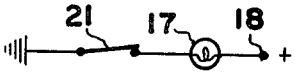
FIG. 13 is a schematic diagram of the switch circuit of FIG. 12.
Figure 16:
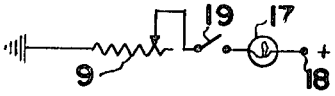
FIG. 16 is a schematic diagram of the switch circuit shown in FIG. 15.
Figure 17:
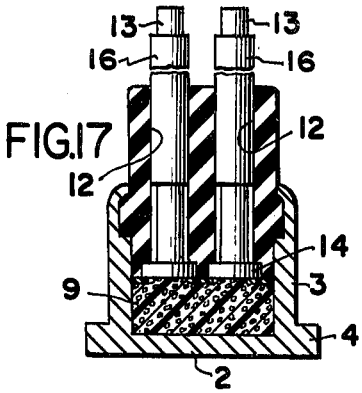
FIG. 17 is a view illustrating the switch of FIG. 15 in conductive condition.
Figure 18:
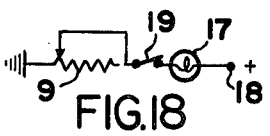
FIG. 18 is a circuit diagram of the switch circuit shown in FIG. 17.
Figure 19:
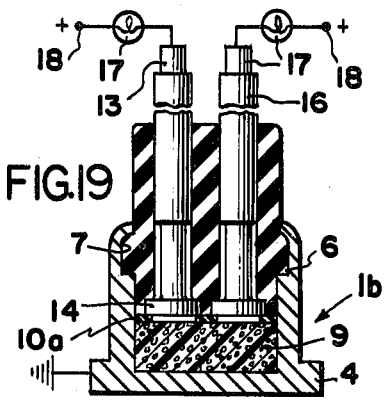
FIG. 19 is a sectional view of a further modification of the invention.
Figure 20:
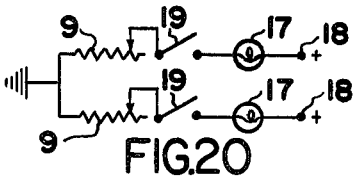
FIG. 20 is a schematic diagram of the switch shown in FIG. 19.
Figure 21:
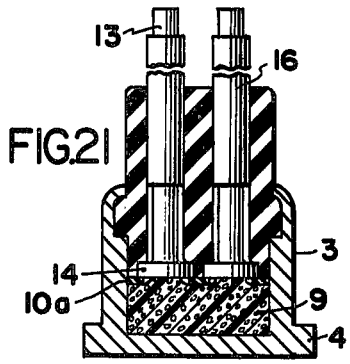
FIG. 21 is a view illustrating the switch of FIG. 19 in conductive condition.
Figure 22:
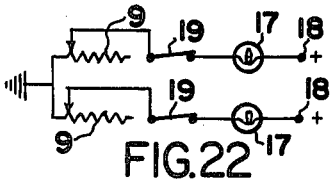
FIG. 22 is a schematic diagram of the switch shown in FIG. 21.
Figure 23:
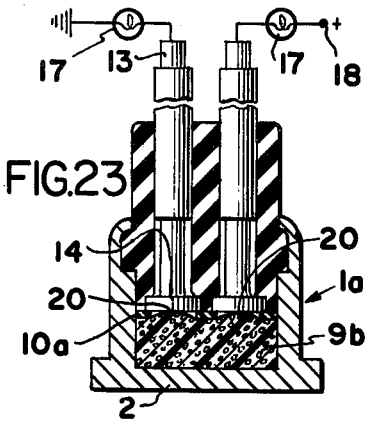
FIG. 23 is a vertical sectional view of a modification of the switch shown in FIGS. 19 and 21.

The embodiment of the invention shown in FIGS. 6-9 corresponds to the earlier described embodiment with the exception that the switching member 9 has a protuberance 20 which projects through the opening 11 in the insulator 10 and constantly engages the terminal 14. As a consequence, a conductive path between the member 9 and the terminal 14 always exists, but when the switching member 9 is relatively cool, as is indicated in FIGS. 6 and 7, the resistance of the member 9 is greater than it is when the member 9 is expanded due to an increase in its temperature, as is indicated in FIGS. 8 and 9.

The embodiment shown in FIGS. 10-13 differs from the embodiment shown in FIGS. 1-5 only in the construction of the switching member. The embodiment shown in FIGS. 10-13 includes a switching member 9*a* formed of a thermally expansible and contractile silicone material like that of the member 9, but the conductive particles contained in the member 9*a* are of such composition that the electrical resistance of the member 9*a* does not change significantly irrespective of the state of compression thereof. Suitable materials for such conductive particles are noble metals, i.e., gold and silver, but substantially the same results may be obtained by utilizing copper particles coated with a noble metal. Such coated particles function like particles formed wholly of a noble metal, but are considerably less expensive.

The switching member 9a may be molded under compression so as normally to be conductive irrespective of the state of its compression. Alternatively, the member 9a may be constructed in such manner as to require the application of compressive force to render it conductive. Whether the member 9a is normally conductive or nonconductive will depend upon the size and quantity of conductive particles contained therein, and whether or not the member is molded under compression, all as is well known in the art. In either case, however, thermal expansion of the member 9a from the condition shown in FIG. 10 to the condition shown in FIG. 12 will establish electrical continuity between the member 9a and the terminal 14, thereby enabling the member 9a to function like an off-on switch as is indicated by the reference character 21 and FIGS. 11 and 13.

The embodiment disclosed in FIGS. 14–18 utilizes a housing 1a like the housing 1 with the exception that the housing 1a is formed of a thermally sensitive, nonconductive metal such as anodized aluminum. In all other respects, the housings are the same and similar reference characters denote similar parts.

Affixed to the housing 1a is an insulating body 5a like the body 5 except that the body 5a has a pair of bores 12 for the accommodation of a pair of conductors 13, each of which has a terminal 14. The switching member 9 occupies the chamber 8 within the housing 1a, and between the member 9 and the terminal 14 is an insulator 10a like the member 10 except that it has two openings 11 in alignment with the respective terminals 14. In this embodiment, one of the conductors 13 is connected via the instrumentality 17 to the energy source and the second conductor 13 is connected to the ground.

In the operation of the embodiment shown in FIGS. 14–18, an increase in the temperature of the switching member 9 will cause it to expand into both of the openings 11 so as to engage both of the terminals 14, thereby establishing circuit continuity between the two terminals. Upon further expansion and consequent compression of the member 9 due to a further increase in its temperature, the resistance of the member 9 decreases. Cooling of the member 9 is accompanied by contraction of the latter, thereby enabling the circuit between the terminals 14 to be broken.

The embodiment shown in FIGS. 19–22 corresponds to the embodiment of FIGS. 14–18, with the exception that the housing 1b is formed of a thermally sensitive, electrically conductive metal such as aluminum. In this embodiment each of the terminals 14 may be connected to an instrumentality 17 and the housing may be grounded and constitute a terminal. The operation of the embodiment of FIGS. 19–22 is like that of the embodiment of FIGS. 14–18.

Figure 24:
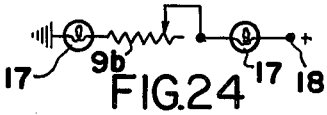
FIG. 24 is a schematic diagram of the switch shown in FIG. 23.
Figure 25:
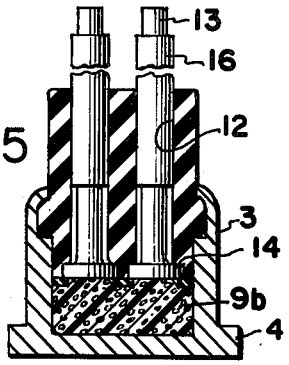
FIG. 25 is a view of the switch shown in FIG. 23 in adjusted condition.
Figure 26:
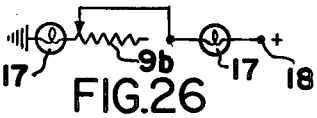
FIG. 26 is a schematic diagram of the switch shown in FIG. 25.

The embodiment illustrated in FIGS. 23–26 includes the nonconductive housing 1a, a pair of conductors 13 each of which terminates in the terminal 14, and the insulator 10a. Occupying the chamber 8 is a switching member 9b like that shown in FIGS. 6 and 8 with the exception that the member 9b includes a pair of protuberances 20 each of which normally engages its associated confronting terminal 14. One of the conductors 13 is connected to the terminal 18 of the energy source via an instrumentality 17 and the other conductor 13 is connected to ground via a similar instrumentality. The circuitry is indicated in FIGS. 24 and 26 as one in which there is continuity between the terminals 14 at all times, but as the member 9b expands, the resistance thereof decreases, and vice versa.

Figure 27:
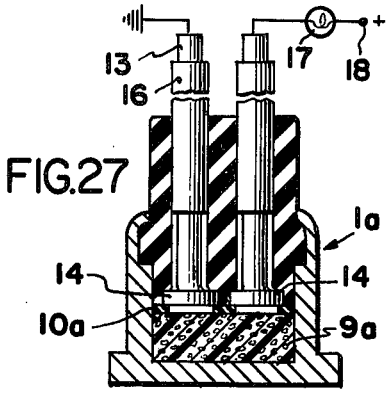
FIG. 27 is a vertical sectional view of a further modification of the invention.
Figure 28:
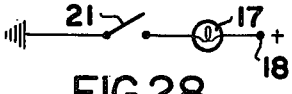
FIG. 28 is a schematic diagram of the switch shown in FIG. 27.
Figure 29:
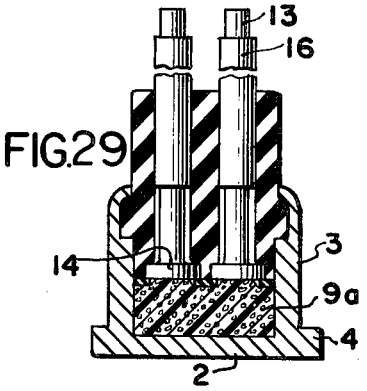
FIG. 29 is a view of the switch shown in FIG. 27, but in conductive condition.
Figure 30:
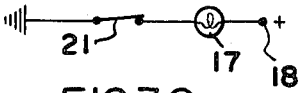
FIG. 30 is a schematic diagram of the switch shown in FIG. 29.
Figure 31:
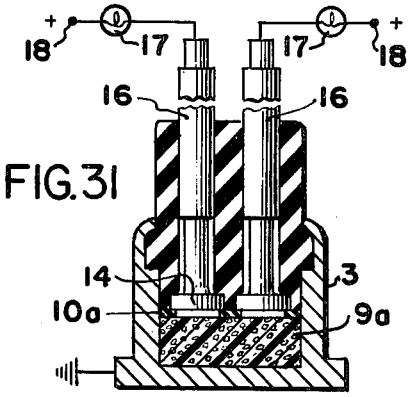
FIG. 31 is a vertical sectional view of still a further modification of the invention.
Figure 32:
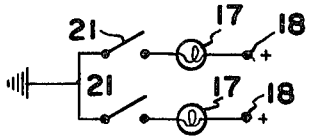
FIG. 32 is a schematic diagram of the switch shown in FIG. 31.
Figure 33:
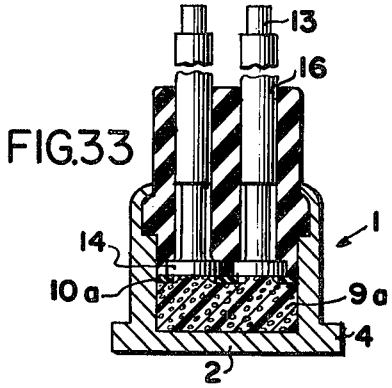
FIG. 33 is a view illustrating the switch of FIG. 31 in conductive condition.
Figure 34:
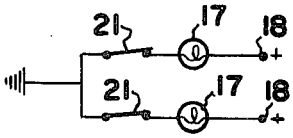
FIG. 34 is a schematic diagram of the circuit of the switch shown in FIG. 33.

The embodiment of FIGS. 27–30 corresponds to the embodiment of FIGS. 15–18 with the exception that in the embodiment of FIGS. 27–30 the switching member 9a is used. When the member 9a is out of engagement with the terminals 14, as shown in FIG. 27, the circuit therebetween is open, but upon thermal expansion of the member 9a into engagement with the terminals 14, as shown in FIG. 29, a circuit is established between the energy source and ground via the member 9a.

The embodiment of FIGS. 31–34 is like that shown in FIGS. 27–30, but differs from the latter by utilizing the conductive housing 1, which is grounded, thereby enabling each of the conductors 13 to be connected to an associated instrumentality 17.

In each of the disclosed embodiments the overall size of the device is extremely small as compared to prior art switches adapted to perform similar functions. For example, housings corresponding to the housings 1 and 1a have been constructed having an overall height of 0.350 inch and a maximum diameter (at the flange 4) of 0.312 inch. Switches constructed according to the disclosed embodiments, therefore, enable significant miniaturization of conventional switches to be achieved.

Calibration of switches constructed according to the invention is a simple matter. In each instance the housing may be heated to a predetermined temperature and the base wall 2 deformed inwardly of the chamber 8 until the resistance of the member 9 or 9b reaches a predetermined value, in the case of a rheostatic switch, or until a circuit is completed through the member 9a, in the case of an on-off switch. A typical inward deformation or indentation for purposes of calibration is indicated by the dotted lines 22 in FIG. 4.

The disclosed embodiments are representative of a presently preferred form of the invention, but are intended to be illustrative rather than definitive thereof. The invention is defined in the claims.

What is claimed is:

1. A thermally sensitive electrical switching device comprising a housing formed of thermally conductive material and having a chamber therein, said chamber being in communication with an opening; an electrically conductive terminal supported by said housing in fixed position relative to said chamber and in communication with said chamber via said opening; and a deformable, elastomeric switching member occupying said chamber and confronting said terminal, said switching member being formed of a thermally sensitive material which expands and contracts, respectively, in response to increases and decreases in its temperature, the relative volumes of said chamber and said switching member being such that thermal expansion of said switching member is limited to a direction toward said terminal, said switching member being electrically conductive at least in its expanded condition.

2. A device according to claim 1 wherein said switching member is electrically conductive in both its expanded and contracted conditions.

3. A device according to claim 2 wherein said switching member is formed of material whose electrical resistance decreases as the temperature of said member increases.

4. A device according to claim 2 wherein said switching member is formed of material whose electrical resistance is substantially constant.

5. A device according to claim 1 wherein said switching member is electrically nonconductive in its contracted condition and conductive in its expanded condition.

6. A device according to claim 1 wherein said switching member has a portion thereof occupying said opening in both the expanded and contracted conditions of said member.

7. A device according to claim 6 wherein said switching member is formed of material whose electrical resistance decreases as the temperature of said material increases.

8. A device according to claim 1 wherein said switching member is spaced from said terminal when said member is in its contracted condition and compressively engages said terminal when in its expanded condition.

9. A device according to claim 8 wherein said switching member is formed of material whose electrical resistance decreases as the temperature of said material increases.

10. A device according to claim 8 wherein said switching member is electrically nonconductive in its contracted condition and conductive in its expanded condition.

11. A thermally sensitive electrical switching device comprising a hollow housing closed at one end and open at its opposite end, said housing being formed of thermally conductive metal; an insulator fitted into said housing in spaced relation to said closed end and forming with the latter a chamber, said insulator having an opening extending therethrough in communication with said chamber; a deformable, elastomeric switching member sandwiched between said closed end of said housing and said insulator and being formed of a material which expands and contracts, respectively, in response to increases and decreases in its temperature; an electrical contact; and means mounting said contact on said housing in fixed relation relative to said chamber in such position that said contact is outside said chamber and confronts said opening, the relative volumes of said chamber and said switching member being such that thermal expansion of the latter is confined to a direction toward said opening, said switching member being electrically conductive at least in its expanded condition.

12. A device according to claim 11 wherein expansion of said switching member is resisted by said contact thereby subjecting said switching member to a compressive force.

13. A device according to claim 12 wherein said switching member is electrically conductive in both its expanded and contracted conditions.

14. A device according to claim 12 wherein said switching member is formed of material whose electrical resistance decreases as the compression of said member increases.

15. A device according to claim 12 wherein said switching member is formed of material whose electrical resistance is substantially constant.

16. A device according to claim 11 wherein said switching member is electrically nonconductive in its contracted condition and conductive in its expanded condition.

* * * * *